US006170892B1

(12) United States Patent
Lantiegne

(10) Patent No.: US 6,170,892 B1
(45) Date of Patent: Jan. 9, 2001

(54) GATE LATCH PULL

(75) Inventor: Paul Lantiegne, 23355 Sand Canyon Cir., Corona, CA (US) 91719-5069

(73) Assignee: Paul Lantiegne, Corona, CA (US)

( * ) Notice: Under 35 U.S.C. 154(b), the term of this patent shall be extended for 0 days.

(21) Appl. No.: 08/980,787

(22) Filed: Dec. 1, 1997

(51) Int. Cl.[7] ..... E05C 3/16

(52) U.S. Cl. ..... 292/235; 292/50; 292/237

(58) Field of Search ..... 292/235, 225, 292/DIG. 29, 236, 237, 196, 200, 202, 238, 198, 205, 28, 30, 38, 41, 50, 53, 84, 86, 125, 127, 133, 135, 141, 171, 174, 227, DIG. 16; 24/16 PB

(56) References Cited

U.S. PATENT DOCUMENTS

| | | | | |
|---|---|---|---|---|
| 204,267 | * | 5/1878 | Under | 292/135 |
| 267,168 | * | 11/1882 | Dudley | 292/30 |
| 916,545 | * | 5/1909 | Feucht | 292/227 |
| 1,024,681 | * | 4/1912 | Estes | 292/125 |
| 1,481,775 | * | 1/1924 | McKinnis | 292/86 |
| 1,630,093 | * | 5/1927 | McPartlin | 292/174 |
| 1,945,932 | * | 2/1934 | Caley | 24/16 PB |
| 3,263,292 | * | 8/1966 | Fekete | 24/16 PB |
| 3,266,831 | * | 8/1966 | Banse | 292/235 |
| 3,433,518 | * | 3/1969 | Foltz | 292/235 |
| 3,973,610 | * | 8/1976 | Ballin | 24/16 PB |
| 4,079,484 | * | 3/1978 | Nakama | 24/16 PB |
| 4,112,988 | * | 9/1978 | Nelson | 24/16 PB |
| 4,305,611 | * | 12/1981 | Robins | 292/238 |
| 4,403,375 | * | 9/1983 | Blum | 24/16 PB |
| 4,477,950 | * | 10/1984 | Cisek et al. | 24/16 PB |
| 4,580,319 | * | 4/1986 | Paradis | 24/16 PB |
| 4,866,816 | * | 9/1989 | Caveney | 24/16 PB |
| 4,993,759 | * | 2/1991 | Thomas | 292/235 |
| 5,078,438 | * | 1/1992 | Bieganski | 292/235 |
| 5,116,090 | * | 5/1992 | Nichandros | 292/236 |
| 5,358,292 | * | 10/1994 | Van Wiebe et al. | 292/235 |
| 5,386,713 | * | 2/1995 | Wilson | 70/280 |
| 5,498,041 | * | 3/1996 | Bezzerides et al. | 292/235 |
| 5,517,838 | * | 5/1996 | Moore | 70/14 |
| 5,581,850 | * | 12/1996 | Acker | 24/16 PB |
| 5,593,033 | * | 1/1997 | Kunreuther | 24/711.1 |
| 5,636,412 | * | 6/1997 | Lodi et al. | 24/16 PB |
| 5,669,111 | * | 9/1997 | Rohaly | 24/16 PB |
| 5,687,455 | * | 11/1997 | Alexander | 24/16 PB |

* cited by examiner

*Primary Examiner*—Teri Pham Luu
(74) *Attorney, Agent, or Firm*—Myers, Dawes & Andras LLP

(57) ABSTRACT

There is disclosed an improvement in a latch for a gate which comprises a latch bar and a cooperating latch mechanism. The latch mechanism has a frame with a flange base for attachment to a gate post and a tongue with a slot to receive the latch bar that is pivotally mounted on the frame. A lever arm extends from the tongue and a gate latch pull is attached to the lever arm and extended through a bore in the gate post to permit operation of the latch from the opposite side of the gate. The improvement of this invention is a gate latch pull that is formed of a flexible plastic having a flexural strength (modulus) no less than about 5,000 psi and a thickness sufficient to permit the latch pull to flex and follow the arcuate movement of the lever arm while retaining sufficient stiffness to permit the pushing of the lever to overcome interference in closing the latch. Preferably the latch pull is provided with a snap retainer to secure one end to the latch tongue lever, and with finger grips at each end.

26 Claims, 3 Drawing Sheets

10
12
14
16
17
18
20
22
24
26
28
30
32

24
25
26
29
31
33
35

27
31
33
35

31
33
35
37

GATE LATCH PULL

BACKGROUND OF THE INVENTION

1. Field of the Invention

This invention relates to an improved gate latch and, to a gate latch pull of improved design and performance.

2. Brief Statement of the Prior Art

Gate latches commonly employ a latch bar with a cooperating latch mechanism. Typically the latch bar is installed on the gate and the latch mechanism is installed on the gate post. Quite a few attempts have been made to provide facile operation of the latch mechanism from the opposite side of the gate and the following patents are cited as typical of these attempts.

U.S. Pat. No. 5,078,438 discloses a gate latch that can be opened from the opposite side of the gate by a grasp ring 22 that is attached to a cord that passes through a hole in the gate and is connected to the latch. U.S. Pat. No. 5,358,292 discloses a gate latch having a pivoted latch lever to which is attached a wire rope, cable or nylon cable with a molded nylon latch clip that extends from the latch lever through a compression spring and bore 44 in gate post to a plastic handle. U.S. Pat. No. 5,655,801 discloses a gate latch that has a handle and rod mechanism provided for opening the latch from the opposite side of the gate. U.S. Pat. No. 1,558,917 discloses a door latch that may be operated from outside the door with a pawl and chain. U.S. Pat. No. 5,498,041 discloses a gate latch assembly that includes a cable that passes through the gate post to allow operation from the other side.

OBJECTIVES OF THE INVENTION

It is an objective of this invention to provide an improvement in a gate latch.

It is an additional objective of this invention to provide a gate latch pull which is simple in construction and installation.

It is also an objective of this invention to provide a gate latch pull which has improved durability and service life.

It is a further objective of this invention to provide a gate latch pull having sufficient stiffness to permit it to exert pushing force on the latch mechanism of the gate latch.

It is likewise an objective of this invention to provide a gate latch pull formed of inexpensive plastics.

Other and further objectives of this invention will be apparent from the following description of the invention.

BRIEF STATEMENT OF THE INVENTION

This invention comprises an improvement in a latch for a gate which comprises a latch bar and a cooperating latch mechanism. The latch mechanism has a frame with a flange base for attachment to a gate post and a tongue that is pivotally mounted on the frame with a slot to receive the latch bar. A lever arm extends from the tongue and a gate latch pull is attached to the lever arm and extended through a bore in the gate post to permit operation of the latch from the opposite side of the gate. In this invention the gate latch pull is formed of a flexible material, preferably plastic, having a flexural strength (modulus) no less than about 5,000 psi and a thickness sufficient to permit the latch pull to flex and follow the arcuate movement of the lever arm while retaining sufficient stiffness to permit the pushing of the lever to overcome interference in closing the latch. Preferably the latch pull is provided with a snap retainer to secure one end to the latch tongue lever, and with finger grips at each end.

BRIEF DESCRIPTION OF THE FIGURES

The invention will be described by reference to the figures as which.

DESCRIPTION OF PREFERRED EMBODIMENT

Figures 1, 6, 7, 8:
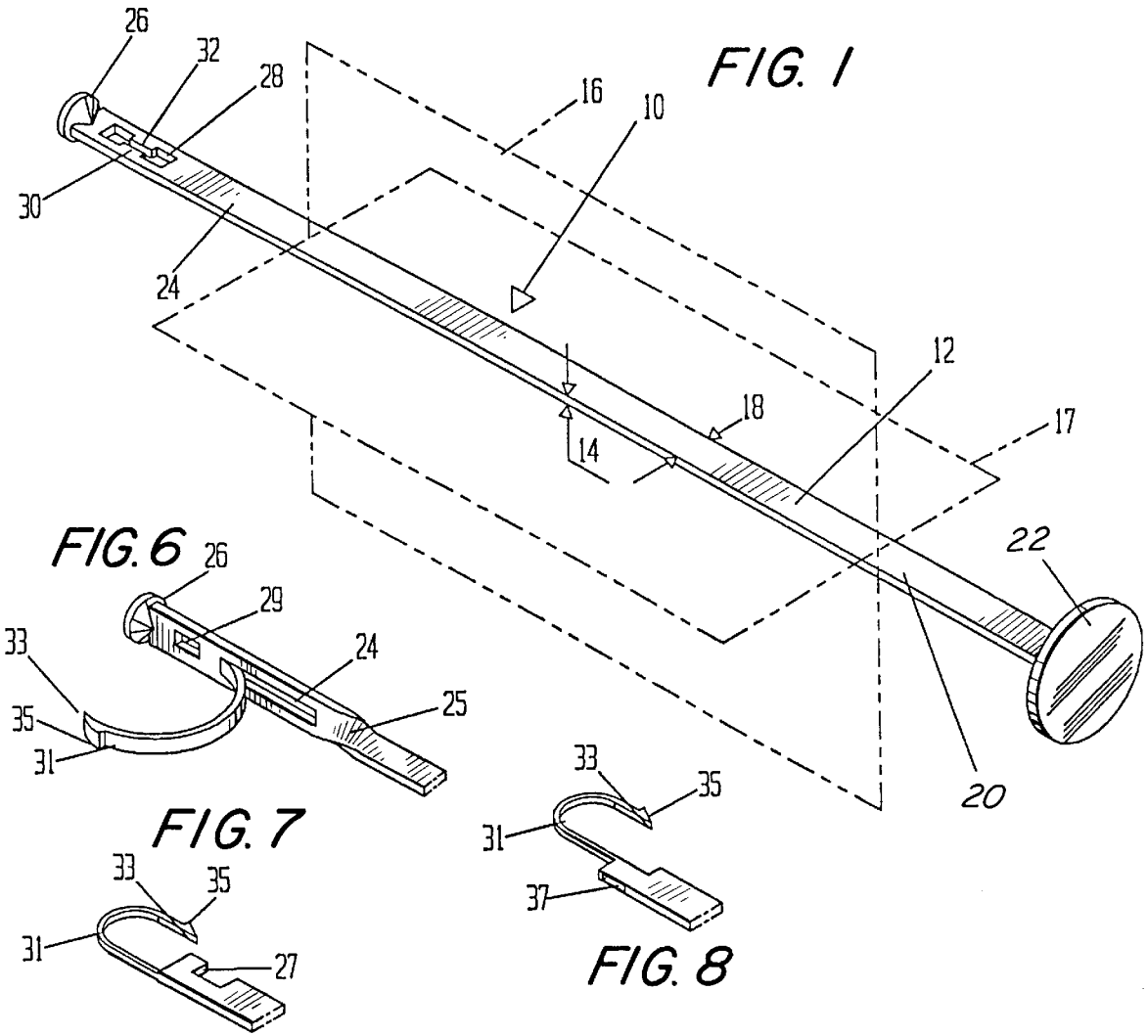
FIG. 1 is a perspective view of the gate latch pull of the invention.
FIGS. 6–8 illustrate an alternative snap retainer to attach the gate latch pull to the lever of a gate latch mechanism.

Referring now to FIG. 1, there is illustrated a gate latch pull 10 of the invention which comprises an elongated, slender plastic band 12. The latch pull 10 is formed of a flexible material having a flexural strength of at least 5,000 psi. Suitable materials include metals such as corrosion resistant aluminum, stainless steel, etc. Preferably, however, plastics are used for this purpose and suitable plastics include low and high polyethylene, polypropylene, polyvinylchloride, nylon, etc. The latch pull is formed with a thickness 14 which ensures that it will be flexible in the plane 16 normal to its width, yet sufficiently stiff to permit the latch pull to exert a pushing force, as described hereinafter. For most plastics, an acceptable thickness is from 0.02 to 0.25 inch, preferably from 0.05 to 0.1 inch. Preferably the band 12 has a width 18 greater than its thickness 14 to provide resistance to flexing in the plane 17 normal to its thickness. For most plastics, an acceptable width is from 0.125 to 1.0 inch, preferably from 0.25 to 0.5 inch.

At one end 20, the latch pull 10 has an integral disc 22 which is of substantially greater diameter than the width 18 of the band 12. At its opposite end 24, the latch pull 10 has a second integral disc 26 of a diameter not significantly greater than the width 18 of the band. Adjacent the end 24, the band 12 has a through slot 28 which has at least one and preferably two prongs 30 and 32 centrally located on the inside walls of the slot. As described in greater detail in reference to FIGS. 2 and 3, the slot 28 and prongs 30 and 32 provide for snap retention of the latch pull 10 to the lever of the latch mechanism.

Figures 2, 3:
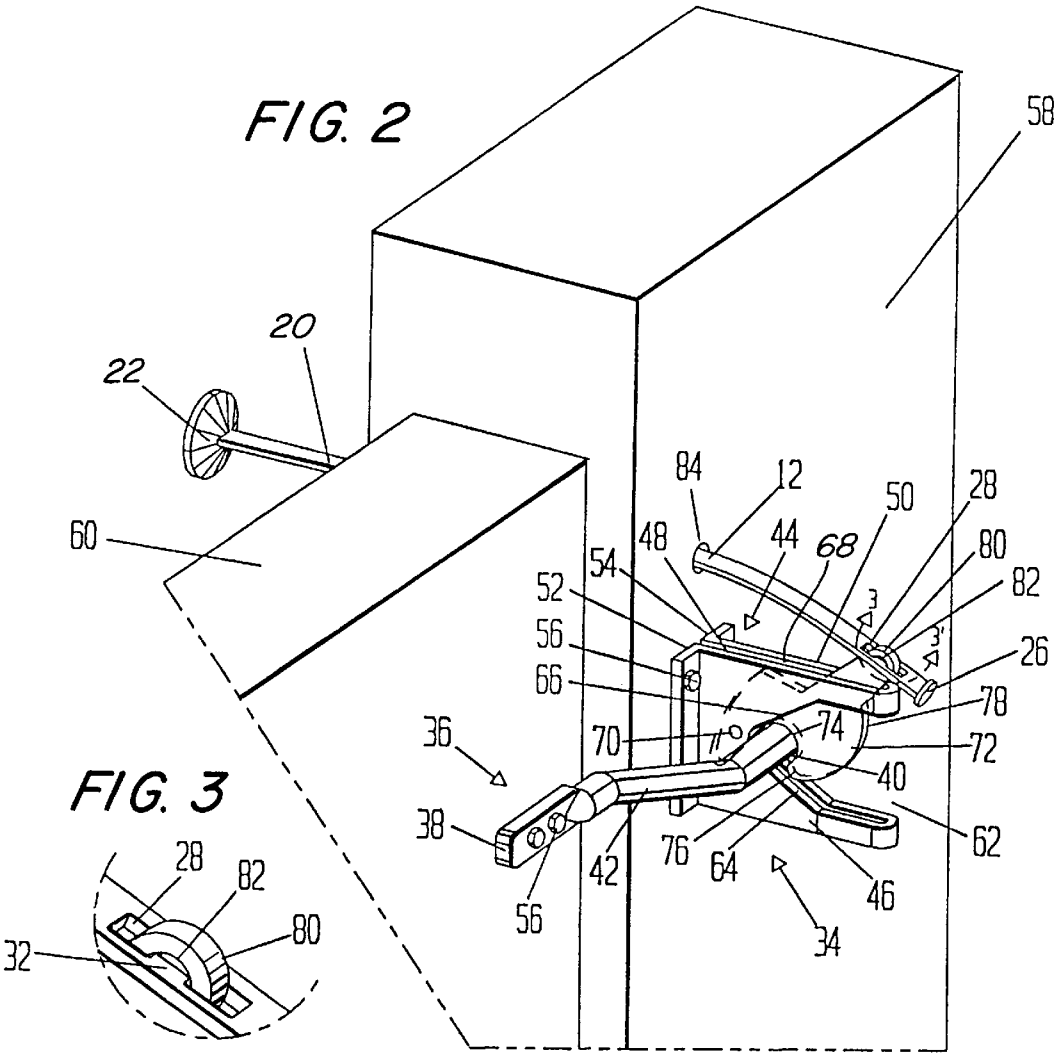
FIG. 2 is a perspective view of the gate latch pull of the invention installed on a gate latch.
FIG. 3 is an enlarged view of the area within line 3–3' of FIG. 2.

Referring now to FIG. 2, the latch 34 comprises a conventional latch bar 36 having a base flange 38 and an extending bar 40 which is offset from the base flange 38 by a bent segment 42 of the bar 36. The base flange has through apertures which receive conventional fasteners 56 to secure the latch bar to the gate 60.

The latch 34 also includes a latch mechanism 44 having a frame 46 formed as a clevis having opposite sides 48 and 50 with orthogonal flanges 52 and 54. The flanges 52 and 54 have through apertures which receive conventional fasteners 56 to secure the latch mechanism to the gate post 58. The latch mechanism frame 46 has a mouth 62 with beveled sides 64 and 66. A tongue 72 is pivotally mounted within the clevis slot 68 of the frame 46 on a pivot pin 70. The tongue 72 has an open recess 74 on its lower edge 76 which is of a diameter approximating the diameter of the bar 40 of the latch bar 36. The tongue 72 pivots between a latch bar capture position shown in FIG. 2 and a latch bar release position in which the slot is open to the mouth 62 of the latch frame 46 permitting the movement of the latch bar from the latch mechanism. The upper edge 78 of the tongue 72 has a protruding lever arm 80 which has a through aperture 82 that is received with a snap retention in the slot 28 of the gate latch pull 10 of the invention. As illustrated in greater detail in FIG. 3, the slot 28 is of sufficient length to receive the end of the lever arm 80 and the prongs 30 and 32 on the opposite inside walls of the slot 28 resiliently snap into the through aperture 82, thereby providing a very simple yet secure retention of the latch pull 10 to the lever arm 80.

In the conventional installation, a through aperture 84 is bored in the gate post 58 and slightly above the position of the latch mechanism 44, preferable centrally located thereabove a sufficient distance to accommodate the arcuate movement of the lever arm 80 of the latch mechanism. The gate latch pull 10 of the invention is inserted through the aperture 84, and for this purpose, the finger grip, disc 26 on the inserted end 24 of the latch pull 10 is of lesser diameter than the diameter of the through aperture 84 in the gate post. Preferably the diameter of the through aperture 84 is slightly greater than the diameter of the disc 26, but less than the diameter of the disc 22 grip on the opposite end 20 of the latch pull 10.

Figure 4:
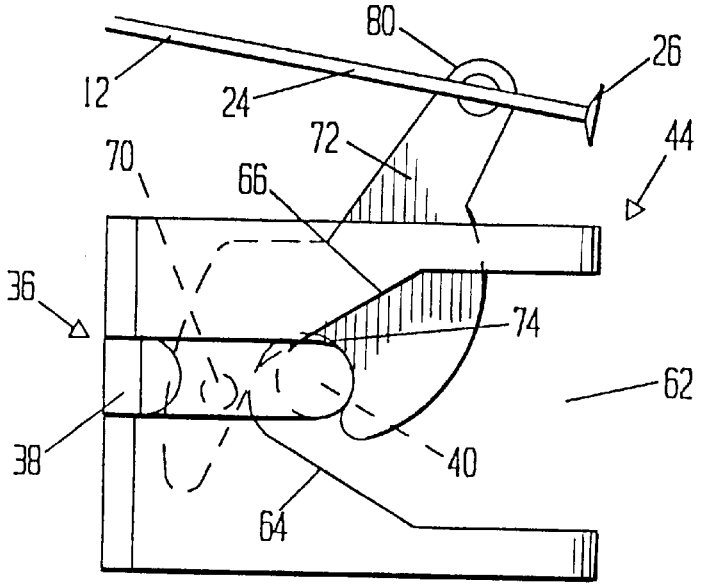
FIGS. 4 and 5 illustrate interferences in the fit of the gate latch mechanism which may be overcome by use of the gate latch pull of this invention.
Figure 5:
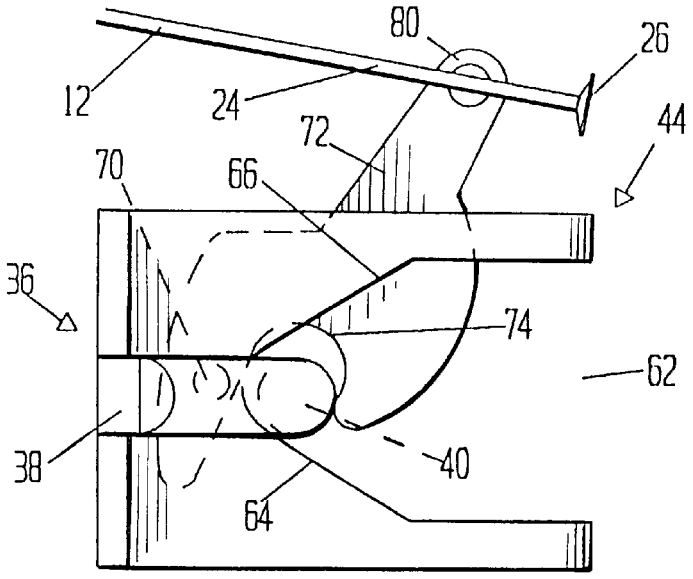

As previously mentioned, the gate latch pull preferably has sufficient stiffness to permit one to exert a pushing force on the lever arm. As illustrated in FIGS. 4 and 5, this feature is important to permit the latch mechanism to overcome slight interferences in the fit between the gate latch bar and the latch mechanism. As illustrated in FIG. 4, the gate latch bar is shown above its aligned position and slightly out of registration with the latch mechanism 44. While the inclined surfaces of the sides 64 and 66 of the mouth 62 of the latch frame 46 are intended to permit self centering of the bar with the latch mechanism, there are some instances where it is not possible to apply the necessary force to the gate to cause registration and movement of the latch tongue into the lock position. The latch pull 10 of this invention however permits the user to overcome slight interferences in the fit of the latch mechanism 44 and the latch bar 40 since the latch pull 10 has sufficient stiffness to permit the user to push against the lever arm 80 of the tongue 72, forcing the tongue downwardly in about the latch bar into the slot or gate securing position. FIG. 5 illustrates another misalignment in which the latch bar 40 is slightly below its precise registration with the latch mechanism 44. Again, the latch pull 10 of the invention permits the user to push against the lever arm 80 and cause the tongue 72 to move about the latch bar 80 and lift it the slight distance necessary for registration and movement of the gate latch tongue 72 into the locked position, securing the latch bar 80.

Referring now to FIG. 6, an alternative snap retainer is shown for attachment of the end 24 of the gate latch pull to a lever of a gate latch mechanism. In this embodiment, the end 24 of the band has a 90° twist and a slot 29 which receives a barb 33 with a shoulder 35 on the end of a flexible strip 31 which is formed from the plastic band. The strip, which is passed through the lever aperture 82 (see FIGS. 2 and 3) of the latch mechanism, has a notch 35 to provide a snap engagement in slot 29.

Alternative snap retainers are also shown in FIGS. 7 and 8. In these embodiments the latch pull has a distal strip 31 with a terminal barb 33 and shoulder 35. The band of the embodiment of FIG. 7 has an aperture 27 to receive the barb 33 and the embodiment of FIG. 8 has an aperture 37 to receive the barb 33 after the distal strips 31 are passed through the lever aperture 82 (see FIGS. 2 and 3).

The gate latch pull of the invention can be readily formed by conventional plastic fabrication techniques such as injection molding, stamping and the like. Preferably it is formed by injection molding and is provided with the finger grips which are preferably formed as in the shape of integral discs in one-piece construction with the band of the gate latch pull.

The invention has been described with reference to the illustrated and presently preferred embodiment. It is not intended that the invention be unduly limited by this disclosure of the preferred embodiment. Instead, it is intended that the invention be defined by the means, and their obvious equivalents, set forth in the following claims.

What is claimed is:

1. In combination with a latch, a hinged gate and a stationary gate post, said latch comprising a cooperative latch bar and latch mechanism, one fixedly attached to the gate and the other fixedly attached to the gate post, wherein the latch mechanism includes a frame, a tongue with a slot to receive said latch bar and a lever arm having an aperture for attachment of a latch pull, said lever arm being pivotally mounted on said frame to move the tongue between a latch bar capture position securing said latch bar and a latch bar release position freeing said latch bar, and including a through aperture in the one of said gate and gate post to which said latch mechanism is fixedly secured, the improvement which comprises:

said through aperture being located in the one of said gate and gate post substantially adjacent an upper end of the lever arm of said tongue when said tongue is in the latch bar release position; and a gate latch pull comprising an elongated band that is wider than it is thick, said band having at one end a snap retainer which is fixedly secured to the end of said lever arm and having its opposite end extending through said aperture, said band being formed of a flexible plastic having a thickness sufficient to permit said band to flex sufficiently in a first plane parallel to its length and normal to its width and having a horizontal width greater than its thickness to provide resistance to flexing in a second plane normal to the first plane to permit the one end of said band to follow the arcuate movement of the lever arm to which it is attached as the upper end of said lever arm moves between a position spaced from said through aperture when the tongue is in the latch bar capture position and a position substantially adjacent to said through aperture when the tongue is in the latch bar release position while retaining sufficient stiffness to permit said band alone to transmit a pushing force from the opposite end of said band to said lever.

2. The combination of claim 1 wherein said plastic has a flexural strength of no less than about 5,000 psi.

3. The combination of claim 2 wherein said band is formed of Nylon with a thickness from about 0.02 to 0.25 inch.

4. The combination of claim 3 wherein said band has a width from about 0.125 to 1.0 inch.

5. The combination of claim 2 including a finger grip on said opposite end of said band.

6. The combination of claim 5 including a second finger grip on said one end of said band.

7. The combination of claim 6 wherein said finger grips are circular discs.

8. The combination of claim 6 wherein the finger grip on said one end of said band is of lesser diameter, and the finger grip on said opposite end of said band is of greater diameter than said through aperture.

9. The combination of claim 1 wherein said snap retainer comprises a through slot in said one end of said band.

10. The combination of claim 9 including at least one prong located on the inside wall of said slot at the middle of said slot to provide a snap detent for engagement in said lever aperture.

11. The combination of claim 1 wherein said snap retainer comprises a barb and coacting slots on said one end of said band.

12. A latch for a gate and a gate post which comprises:

a. a latch bar having a base flange for attachment to one of said gate and gate post; and b. a latch mechanism having:

(1) a frame with a base flange for attachment to the other of said gate and gate post;

(2) a tongue with a slot to receive said latch bar and pivotally mounted on said frame to move between a latch bar capture position securing said latch bar and a latch bar release position freeing said latch bar;

(3) a lever arm on said tongue and having a lever aperture for attachment of a latch pull; and (4) a gate latch pull comprising a band of rectangular cross section having at one end thereof a snap retainer permitting its engagement of said lever aperture of said lever arm for attachment thereto and being formed of a flexible material having a thickness sufficient to permit said latch pull to flex sufficiently in a plane parallel to its length and normal to its width to permit the one end of said band to follow the arcuate movement of the latch lever while retaining sufficient thickness and having a horizontal width greater than its thickness to provide resistance to flexing in a plane parallel to its length and normal to its thickness to permit said band to transmit a pushing force from an opposite end of said band to said lever with substantially no deflection in the plane parallel to its length and normal to its thickness.

13. The latch for a gate and gate post of claim 12 wherein said snap retainer comprises a through slot in said one end of said band.

14. The latch for a gate and gate post of claim 13 including at least one prong located on the inside wall of said slot at the middle of said slot to provide a snap detent for engagement in said lever aperture.

15. The latch for a gate and gate post of claim 12 wherein said snap retainer comprises a barb and coacting slots on said one end of said band.

16. The latch of claim 12 wherein said material is a plastic having a flexural strength no less than about 5,000 psi.

17. The latch for a gate and gate post of claim 16 wherein said band is formed of Nylon with a thickness from about 0.02 to 0.25 inch.

18. The latch for a gate and gate post of claim 17 wherein said band has a width from about 0.125 to 1.0 inch.

19. The latch for a gate and gate post of claim 16 including a finger grip on said opposite end of said band.

20. The latch for a gate and gate post of claim 19 including a second finger grip on said one end of said band.

21. The latch for a gate and gate post of claim 20 wherein said finger grips are circular discs.

22. The latch for a gate and gate post of claim 21 wherein the finger grip on said one end of said band is of lesser diameter for providing passage through a through aperture in one of said gate and said post, and the finger grip on the opposite end of said band is of a greater diameter for preventing passage through said through aperture.

23. A gate latch pull comprising:

a band of rectangular cross section having an integrally formed snap retainer at one end thereof and being formed of a flexible plastic having a flexural strength no less than about 5,000 PSI and a width and a thickness sufficient to permit said band to flex in a plane parallel to its length and normal to its width with substantially no deflection in a plane parallel to its length and parallel to its thickness, and including a first finger grip integrally formed on said one end of said band, said first finger grip comprising a first circular disk that is normal to the length of the band and has a diameter that is substantially equal to the width of said band, and a second finger grip integrally formed on an opposite end of said band, said second finger grip comprising a second circular disk that is normal to the length of the band and has a diameter that is substantially greater than the width of said band.

24. The gate latch pull of claim 23 wherein the finger grip on said one end of said band is of lesser diameter than the finger grip on the opposite end of said band.

25. The gate latch pull of claim 23 wherein said band is formed of Nylon with a thickness from about 0.02 to 0.25 inch.

26. The gate latch pull of claim 23 wherein said band has a width from about 0.125 to 1.0 inch.

* * * * *